United States Patent [19]

Hidemi et al.

[11] Patent Number: 4,571,490

[45] Date of Patent: Feb. 18, 1986

[54] PARKING STATION SUPERVISORY SYSTEM

[75] Inventors: Komine Hidemi; Kato Hiroshi, both of Yokohama, Japan

[73] Assignee: Amano Corporation, Yokohama, Japan

[21] Appl. No.: 598,452

[22] Filed: Apr. 9, 1984

[30] Foreign Application Priority Data

Apr. 7, 1983 [JP] Japan ..... 58-61668

[51] Int. Cl.[4] ..... G07B 15/02

[52] U.S. Cl. ..... 235/384; 235/378

[58] Field of Search ..... 235/384, 378

[56] References Cited

U.S. PATENT DOCUMENTS 3,287,543 11/1966 Hacpern ..... 235/384 x

*Primary Examiner*—Harold I. Pitts

*Attorney, Agent, or Firm*—Wenderoth, Lind & Ponack

[57] ABSTRACT

A parking station supervisory system particularly contemplated to avoid a traffic congestion when a vehicle is leaving is disclosed. It has a vehicle entry detector provided at an entrance, an automatic ticket issuance device installed close to the entrance, a parking fee adjusting device installed at an adequate place where drivers or users often drop in, and a vehicle departure control device installed at an exit of the parking station. When a parking ticket is inserted, the parking fee adjusting device reads the entry time recorded on the ticket and calculates the parking fee. Upon payment of the parking fee, the ticket is returned to a driver with an allowable departure time recorded on it. When a vehicle is going to leave, the driver is only required to insert the ticket into the vehicle departure control device. As long as it is within the allowable departure time, an exit gate bar is immediately opened for allowing the vehicle to leave.

7 Claims, 4 Drawing Figures

PARKING STATION SUPERVISORY SYSTEM

BACKGROUND OF THE INVENTION

The present invention relates to a parking station supervisory system for automatically effecting the supervision of a parking station, such as a vehicle entry and a vehicle departure, or calculation and collection of a parking fee, and more particularly to a parking station supervisory system with the provision of means capable of preventing a traffic congestion when a vehicle is leaving.

In a conventional parking station supervisory system constituted such that calculation and collection of a parking fee is automatically conducted and the parking station is controlled by either a man or unman, a parking fee adjusting device is installed at an exit of the parking station and when a parking ticket is inserted, it calculates the parking fee by reading the vehicle entry time recorded on the ticket and opens an exit gate only after payment of the parking fee for allowing a vehicle to leave. Therefore, when leaving, the driver must drive a vehicle up to the parking fee adjusting device for effecting settlement of the parking fee. Since he has to effect the settlement of the parking fee while driving the vehicle, he not only experiences inconvenience but also apts to encounter the risk of comparatively high possibility of traffic accident because he has to give his attention to both driving and settlement. Moreover, since it takes time for settlement or adjustment of the parking fee, a long waiting line of leaving vehicles is often seen especially in a giant parking station, which eventually compels drivers to pay unreasonable extra parking fees. Furthermore, in a giant parking station having a plurality of exits, comparatively expensive parking fee adjusting devices must be installed each at every exit. Therefore, the costs of the overall system become very expensive thus creating an ecconomic problem.

SUMMARY OF THE INVENTION

The present invention is accomplished in order to eliminate the above inconveniences and problems.

It is therefore a primary object of the present invention to provide a parking station supervisory system which can control a smooth flow of leaving vehicles by providing means for effecting parking fee adjustment or parking fee settlement in advance at another place or places than a vehicle exit.

Another object of the invention is to provide a comparatively inexpensive parking station supervisory system by installing a less expensive vehicle departure control device or vehicle departure controlling machine at the vehicle exit in the place of a conventional expensive parking fee adjusting device.

A further object of the present invention is to provide a parking station supervisory system wherein parking fee adjustment or settlement can be effected without a vehicle, thus enabling the vehicle departure safely.

Still a further object of the invention is to provide a parking station supervisory system where drivers do not have to pay unreasonable extra parking fees due to long waiting time for adjustment or settlement.

To achieve the above mentioned objects and others, there is essentially provided a parking station supervisory system comprising a vehicle entry detector provided at an entrance of the parking station; an automatic ticket issuance device installed close to said entrance, said automatic ticket issuance device issuing a ticket responsive to a detecting signal sent from said vehicle entry detector and when the ticket is pulled out of a ticket pocket, an entrance gate bar being opened responsive to an opening signal sent from said automatic issuance device enabling a vehicle to enter; a parking fee adjusting device installed at an adequate place for reading the entry time recorded on the ticket inserted therein in order to calculate a parking fee and recording an allowable departure time on the ticket upon payment of the parking fee; and a vehicle departure control device installed close to an exit of the parking station for reading the allowable departure time recorded on the ticket inserted therein and opening an exit gate bar only when the present time is within the allowable departure time, by sending an opening signal thereto.

BRIEF DESCRIPTION OF THE DRAWINGS

The above and other objects and novel features of the present invention will become more fully apparent from the following detailed description when the same is read in conjunction with the accompanying sheet of drawings. It is to be expressly understood, however, that the drawings are for purpose of illustration only and are not intended as a definition of the limits of the invention.

DETAILED DESCRIPTION OF THE PREFERRED EMBODIMENT

Figure 1:
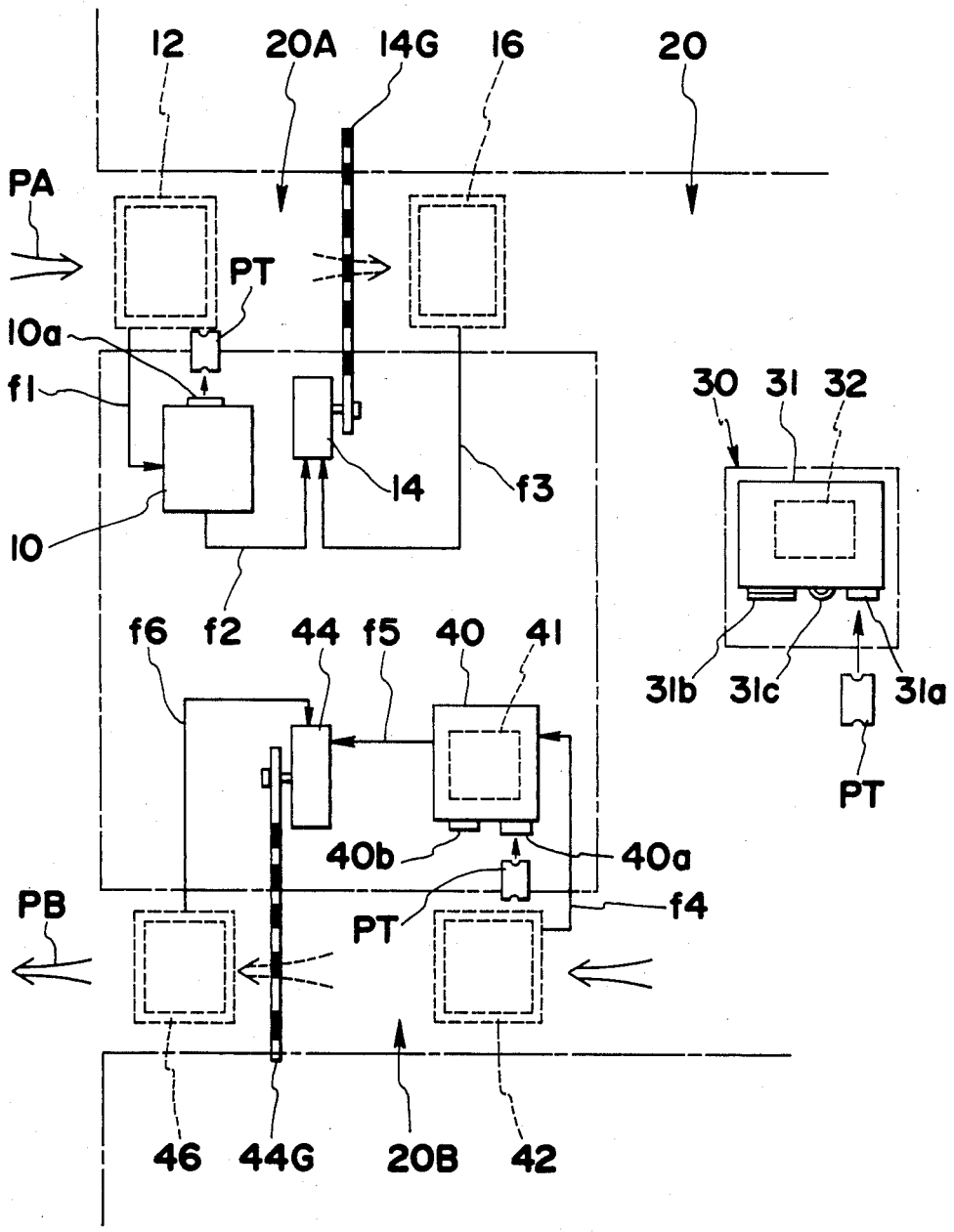
FIG. 1 is a block diagram illustrating a parking station supervisory system according to the present invention.

A preferred embodiment of the present invention will be described hereinafter with reference to the accompanying drawings. FIG. 1 illustrates a block diagram of a parking station supervisory system according to a preferred embodiment of the present invention. In the drawing, numeral 10 denotes a parking ticket issuance device installed close to a vehicle entrance 20A of a parking station 20. Numeral 12 denotes a first vehicle detector such as a loop coil embedded in a vehicle passage at the inner area of the entrance 20. When a vehicle (not shown) advancing in the direction shown by an arrow PA is detected by said first vehicle detector 12, a signal or detecting signal f1 is sent into the parking ticket issuance device 10 from said detector 12. In accordance with said signal f1, the parking ticket issuance device 10 issues a parking ticket PT. When a driver pulls out the parking ticket PT from a ticket issuing pocket 10*a*, a signal or gate opening signal f2 is sent into an entrance gate driving mechanism 14 from said parking ticket issuance device 10. According to said signal f2, an entrance gate bar 14G rotatably connected at its one end to said entrance driving mechanism 14 is opened allowing the vehicle to enter. Numeral 16 denotes a second vehicle detector such as a loop coil embedded in a vehicle passage at the inner area of said entrance gate bar 14G. When the vehicle passes on the second vehicle detector 16, a signal or gate closing signal f3 is sent into said entrance gate driving mechanism 14 for closing said entrance gate bar 14G and thus a vehicle entry is completed.

Next, numeral 30 denotes a parking fee adjustment station or settlement station installed at an appropriate place or places regardless whether it is the inside or outside of the parking station. Preferably, it should be installed at a convenient place or places for drivers or users to drop in. Numeral 3l denotes a manned or unmanned parking fee adjusting device or settlement device provided at the inside of said parking fee adjusting station 30. Numeral 32 denotes a computing and processing unit assembled in said parking fee adjusting device 31. When a driver or user inserts a parking ticket issued by said parking ticket issuance device 20A into a parking ticket receiving pocket 31*a* provided at the front of said parking fee adjusting device 31, said parking fee adjusting device 31 calculates the parking fee based on time difference between the entry time and the present time or departure time and the parking fee is shown on a display 31*b*. Where an unmanned parking fee adjusting device 31 is employed, when a driver effects the required payment by throwing a coin or coins corresponding to the parking fee shown on the display 31*b*, the parking ticket PT is automatically returned again to said parking ticket receiving pocket 31*a* after recording an allowable departure time thereon, which is determined by adding a pre-fixed time, for example, about 10 to 30 minutes, to the present time. Where a manned parking fee adjusting device 31 is employed, a clerk-in-charge returns the parking ticket PT to the driver upon receiving the parking fee and recording the allowable departure time.

Numeral 40 denotes a departure control device or controlling machine installed close to an exit 20B of the parking station 20 and numeral 41 denotes a computing and processing unit assembled therein. When said computing and processing unit 41 receives a vehicle detecting signal F4 from a first exit detector 42 such as loop coil embedded in a vehicle passage at the inner area of the vehicle exit 20B, it opens a parking ticket receiving pocket 40*a* thereby permitting the parking ticket PT to be inserted. At the same time, when said computing and processing unit 41 finds that the present time is within said allowable departure time, it sends a signal or gate opening signal f5 into a gate driving mechanism 44 to open an exit gate bar 44G for allowing a vehicle to leave. When the present time is found to be over the allowable departure time, the gate opening signal f5 is not sent into the exit gate driving mechanism 44 thereby prohibiting the departure of a vehicle. In this case, a clerk-in-charge inserts another card manually to show an extra parking fee on a display 40*b*. Upon payment of the extra parking fee, the vehicle can leave the exit gate as in the same manner as mentioned above.

Numeral 46 denotes a second exit vehicle detector such as a loop coil embedded in the vehicle passage at the vehicle exit 20B. When the vehicle passes on said detector 46, a signal or exit gate closing signal f6 is sent into the gate driving mechanism 44 for closing the exit gate bar 44G again and thus a vehicle departure is completed as shown by an arrow PB.

Figure 2:
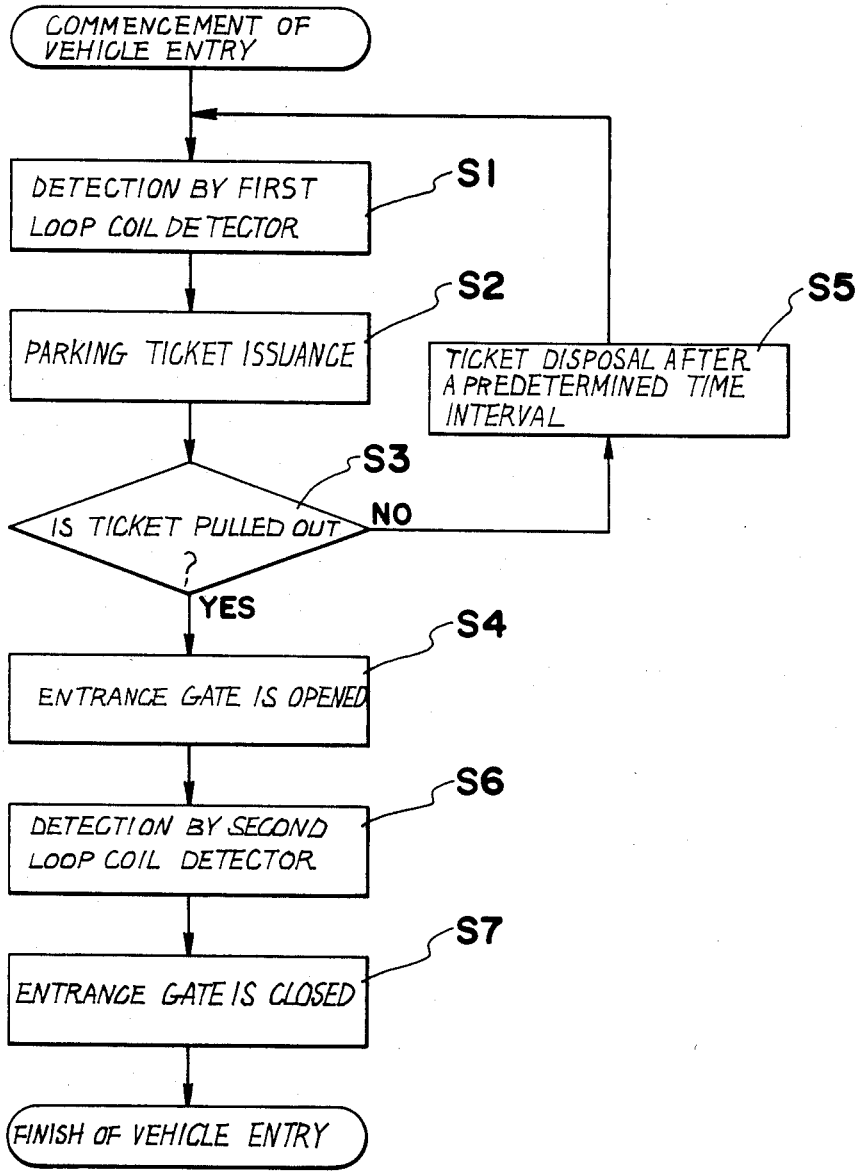
FIG. 2 is a flowchart illustrating a vehicle entry.

FIG. 2 is a flowchart illustrating in detail a vehicle entry according to one embodiment of the present invention. The vehicle entry is made in the order of the steps from S1 to S7 as shown in FIG. 2.

Figure 3:
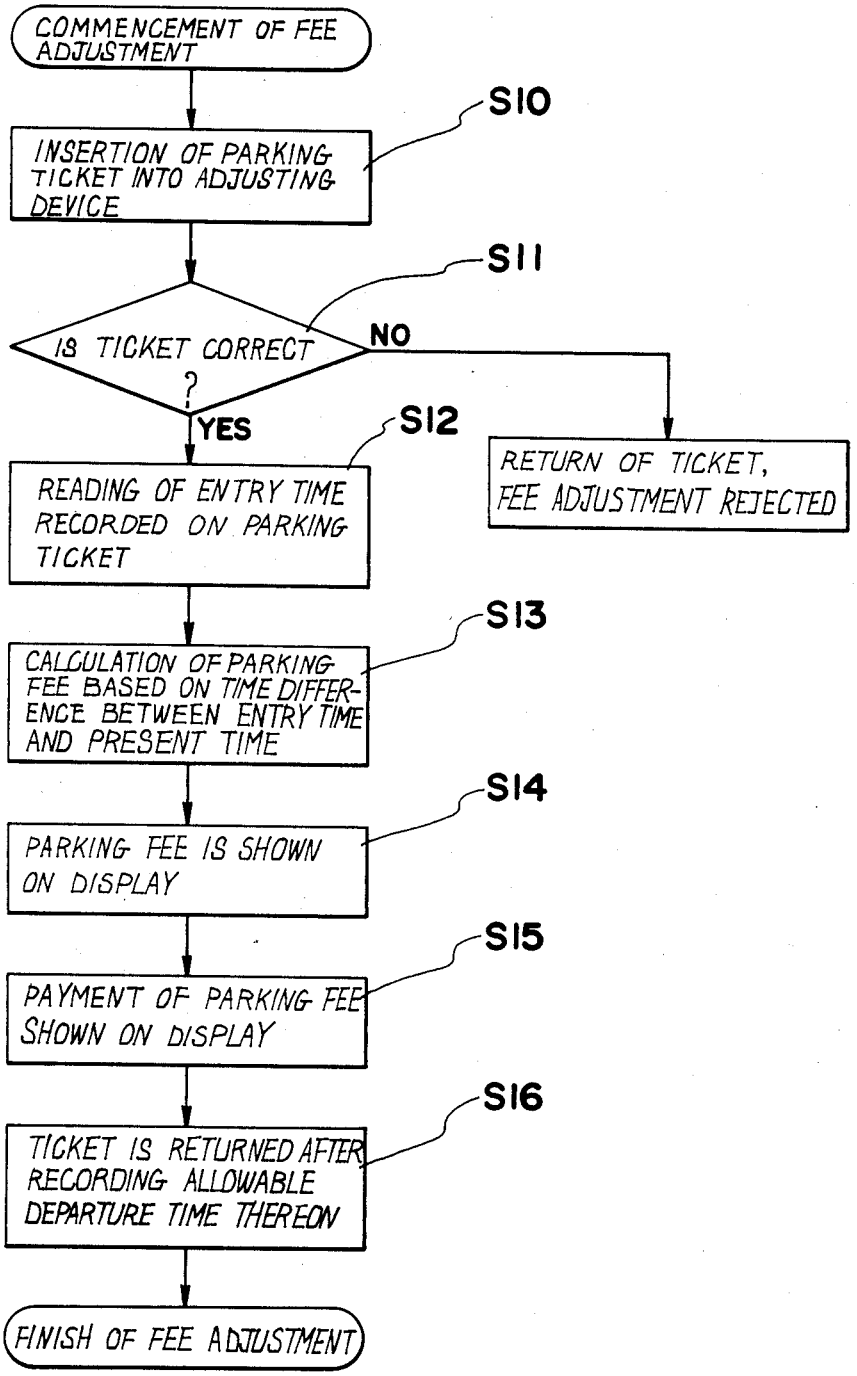
FIG. 3 is a flowchart illustrating a parking fee adjustment or settlement.

FIG. 3 is a flowchart illustrating in detail the processes of the parking fee adjustment using the automatic parking fee adjusting device 31 and the parking ticket PT being returned after recorded with an allowable departure time. In the drawing, S10 through S16 show the steps of the parking fee adjustment as well as the recordal of the allowable departure time. Particularly, each step 11 through 16 exepting only step 15 is processed according to a program stored in a read only memory provided in said computing and processing unit 32 constituted by a microcomputer or the like.

Figure 4:
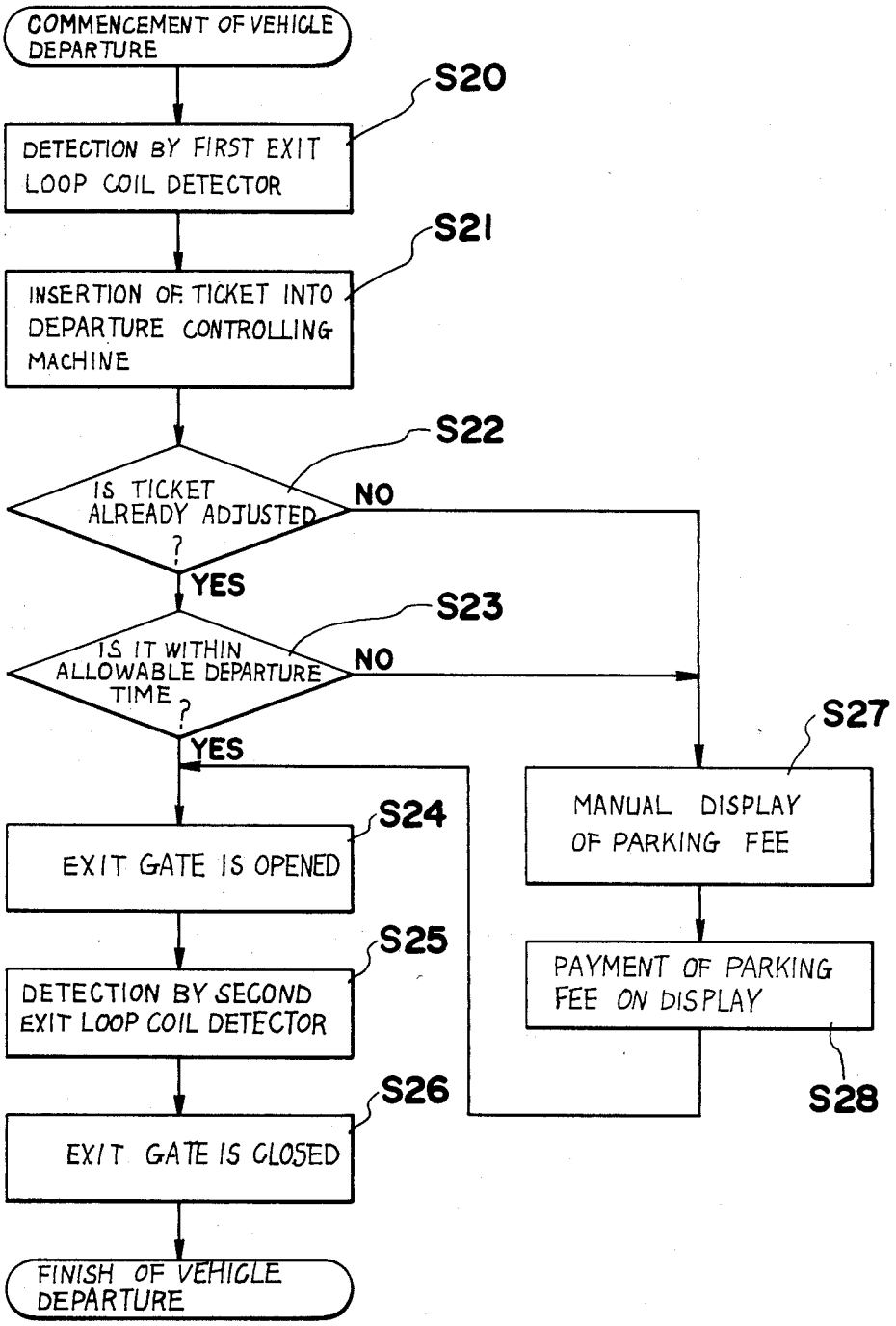
FIG. 4 is a flowchart illustrating a vehicle departure.

FIG. 4 is a flowchart illustrating in detail the vehicle departure and S20 through S28 show the respective steps. Among these steps, the processing of each step S22 through S24 is programmed and stored in the read only memory in said computing and processing unit 32 constituted by a microcomputer or the like.

As described in the foregoing, according to the parking supervisory system of the present invention, when a vehicle is to be left after shopping or the like is finished, the driver or user can drop in the parking fee adjusting station first and effect the settlement of the parking fee. Then, he can drive his vehicle towards the exit within the allowable departure time recorded on the parking ticket returned. What he has to do at the exit is only to insert the parking ticket into the vehicle departure control device and then the exit gate bar is opened for allowing the vehicle to leave. Since a vehicle is not required when the parking fee is settled, the parking fee adjustment or settlement can be quite smoothly conducted. Moreover, since the departure control device reads the parking ticket, finds whether or not it is within the allowable departure time and opens the exit gate bar immediately for allowing the vehicle to leave, if it is found to be within the allowable departure time, there is no worry for drivers to wait for a long time at the parking fee adjusting device or the vehicle exit of the parking station by forming a long waiting line of vehicles. Drivers do not have to pay unreasonable extra parking fees due to long waiting time for settlement of the parking fee. Since drivers' complaints can thus be solved, a smooth control of the parking station is made possible. Furthermore, according to the present invention, since a comparatively less expensive departure control device can be installed at the exit of the parking station instead of a comparatively expensive parking fee adjusting device, the total cost of the supervisory system can largely be reduced. The present invention is particularly good for a giant parking station to be employed.

What is claimed is:

1. A parking station supervisory system comprising:

a vehicle entry detector provided at an entrance of the parking station;

an automatic ticket issuance device installed close to said entrance, said automatic ticket issuance device issuing a ticket responsive to a detecting signal sent from said vehicle entry detector and when the ticket is pulled out of a ticket pocket, an entrance gate bar being opened responsive to an opening signal sent from said automatic ticket issuance device enabling a vehicle to enter;

a parking fee adjusting device installed at an adequate place for reading the entry time recorded on the ticket inserted therein in order to calculate a parking fee and recording an allowable departure time on the ticket upon payment of the parking fee; and a vehicle departure control device installed close to an exit of the parking station for reading the allowable departure time recorded on the ticket inserted therein and opening an exit gate bar only when the present time is within the allowable departure time, by sending an opening signal thereto.

2. A parking station supervisory system according to claim 1, wherein said parking fee adjusting device comprises a reading, calculating and recording circuitary unit.

3. A parking station supervisory system according to claim 2, wherein said circuitary unit is constituted by a microcomputer.

4. A parking station supervisory system according to claims 2 and 3, wherein said reading, calculating and recording operation is effected in accordance with a program stored in a read only memory provided in said reading, calculating and recording unit.

5. A parking station supervisory system according to claim 1, wherein said vehicle entry detector comprises a loop coil responsive to the vehicle.

6. A parking station supervisory system according to claim 1, wherein said parking fee adjusting device is installed the inside of the parking station.

7. A parking station supervisory system according to claim 1, wherein said parking fee adjusting device is installed the outside of the parking station.

* * * * *